US010107290B2

(12) United States Patent
Hagita et al.

(10) Patent No.: US 10,107,290 B2
(45) Date of Patent: Oct. 23, 2018

(54) SCROLL COMPRESSOR INCLUDING A DISCHARGE PORT FOR DISCHARGING HIGH-PRESSURE GAS PROVIDED AROUND THE PERIPHERY OF A RIB IN THE DISCHARGE CAVITY

(71) Applicant: MITSUBISHI HEAVY INDUSTRIES THERMAL SYSTEMS, LTD., Minato-ku, Tokyo (JP)

(72) Inventors: Takayuki Hagita, Aichi (JP); Masafumi Hamasaki, Tokyo (JP)

(73) Assignee: MITSUBISHI HEAVY INDUSTRIES THERMAL SYSTEMS, LTD., Tokyo (JP)

( * ) Notice: Subject to any disclaimer, the term of this patent is extended or adjusted under 35 U.S.C. 154(b) by 0 days.

(21) Appl. No.: 15/308,464

(22) PCT Filed: May 29, 2015

(86) PCT No.: PCT/JP2015/065676
§ 371 (c)(1),
(2) Date: Nov. 2, 2016

(87) PCT Pub. No.: WO2015/186641
PCT Pub. Date: Dec. 10, 2015

(65) Prior Publication Data

US 2017/0167490 A1 Jun. 15, 2017

(30) Foreign Application Priority Data

Jun. 5, 2014 (JP) ..... 2014-116835

(51) Int. Cl.
*F03C 2/00* (2006.01)
*F04C 2/00* (2006.01)
(Continued)

(52) U.S. Cl.
CPC ..... *F04C 29/12* (2013.01); *F04C 18/0215* (2013.01); *F04C 18/0261* (2013.01); *F04C 27/005* (2013.01); *F04C 28/24* (2013.01)

(58) Field of Classification Search
CPC .... F04C 29/12; F04C 29/128; F04C 18/0215; F04C 18/0261; F04C 27/005; F04C 28/24; F04C 23/008
(Continued)

(56) References Cited

U.S. PATENT DOCUMENTS 5,545,020 A 8/1996 Fukanuma et al.
2003/0223898 A1 12/2003 Fujioka et al.
(Continued)

FOREIGN PATENT DOCUMENTS

JP 09032780 A * 2/1997 ..... F04C 29/0035
JP 11-336675 A 12/1999
(Continued)

*Primary Examiner* — Theresa Trieu
(74) *Attorney, Agent, or Firm* — Birch, Stewart, Kolasch & Birch, LLP

(57) ABSTRACT

This scroll compressor is a scroll compressor provided with a housing and a scroll compression mechanism provided inside the housing, the interior of the housing being provided with an discharge cavity for discharge high-pressure gas compressed by the scroll compression mechanism, wherein: the housing is configured from a front housing and a rear housing for closing the rear-end opening of the front housing; a fixed scroll is integrally molded on the rear housing with a rib part interposed therebetween; the discharge cavity, into which an discharge port for discharging high-pressure gas opens, is provided around the periphery of the rib part; and an discharge valve for opening and closing the discharge port is installed in the discharge cavity.

8 Claims, 6 Drawing Sheets

(51) Int. Cl.

| | |
|---|---|
| ***F04C 18/00*** | (2006.01) |
| ***F04C 29/12*** | (2006.01) |
| ***F04C 18/02*** | (2006.01) |
| ***F04C 27/00*** | (2006.01) |
| ***F04C 28/24*** | (2006.01) |

(58) Field of Classification Search
USPC ..... 418/55.1–55.6, 57, 149, 270
See application file for complete search history.

(56) References Cited

U.S. PATENT DOCUMENTS

| | | | | |
|---|---|---|---|---|
| 2009/0285708 | A1* | 11/2009 | Yokoi | F04C 18/0215 418/55.6 |
| 2010/0254843 | A1 | 10/2010 | Chu | |
| 2011/0300011 | A1* | 12/2011 | Ohno | F04C 18/0215 418/55.1 |
| 2013/0071279 | A1* | 3/2013 | Iizuka | F04C 18/0246 418/55.2 |
| 2014/0308146 | A1 | 10/2014 | Hirata et al. | |

FOREIGN PATENT DOCUMENTS

| | | | | |
|---|---|---|---|---|
| JP | 3206221 | B2 | 9/2001 | |
| JP | 2002-206491 | A | 7/2002 | |
| JP | 2003083268 | A * | 3/2003 | F04C 18/0215 |
| JP | 2003-201977 | A | 7/2003 | |
| JP | 3509102 | B2 | 3/2004 | |
| JP | 4040300 | B2 | 1/2008 | |
| JP | 2010-116789 | A | 5/2010 | |
| JP | 2012-229650 | A | 11/2012 | |
| JP | 2013-127259 | A | 6/2013 | |
| JP | 2013-144940 | A | 7/2013 | |

* cited by examiner

SCROLL COMPRESSOR INCLUDING A DISCHARGE PORT FOR DISCHARGING HIGH-PRESSURE GAS PROVIDED AROUND THE PERIPHERY OF A RIB IN THE DISCHARGE CAVITY

TECHNICAL FIELD

The present invention relates to a scroll compressor in which a scroll compression mechanism is accommodated and installed inside a housing.

BACKGROUND ART

In scroll compressors in which a scroll compression mechanism is accommodated and installed inside a housing, a scroll compressor, in which an discharge cavity for discharging a high-pressure gas compressed by a scroll compression mechanism is formed inside the housing, and the high-pressure gas is expelled to the outside in a state where discharge pulsation or the like inside the discharge cavity decreases, is widely used in a vehicular air conditioner or the like.

For example, as the scroll compressor, scroll compressors which are described in PTLs 1 to 5 are known in the related art. PTLs 1 and 4 disclose a configuration in which a housing forming an outline of a compressor is configured of a front housing, an outer peripheral portion of a fixed scroll, and a rear housing, a scroll compression mechanism including the fixed scroll and orbiting scroll is incorporated into the housing, and an discharge cavity is formed between an end plate back face of the fixed scroll and a rear housing. PTL 2 discloses a configuration in which a rear housing is fastened to a rear-end opening of a front housing configuring a housing with a fixed scroll interposed therebetween, a scroll compression mechanism including a fixed scroll and a orbiting scroll is incorporated into the housing, and an discharge cavity is formed between an end plate back face of the fixed scroll and the rear housing.

In addition, PTL 3 discloses a configuration in which a front housing is fastened to a front end opening of a rear housing configuring a housing, a fixed scroll is installed to be fixed to a bottom surface side of the rear housing, a scroll compression mechanism including a pair of a fixed scroll and orbiting scroll is incorporated into the housing, and an discharge cavity is formed between the end plate back face of the fixed scroll and the rear housing. In addition, PTL 5 discloses a configuration in which a rear housing is fastened to a rear-end opening of the front housing configuring a housing, a fixed scroll is installed to be fixed to the inner surface side of the rear housing, a scroll compression mechanism including a pair of a fixed scroll and orbiting scroll is incorporated into the housing, and an discharge cavity is formed between the end plate back face of the fixed scroll and the rear housing.

CITATION LIST

Patent Literature

[PTL 1] Japanese Unexamined Patent Application Publication No. 11-336675

[PTL 2] Japanese Unexamined Patent Application Publication No. 2002-206491

[PTL 3] Japanese Unexamined Patent Application Publication No. 2010-116789

[PTL 4] Japanese Unexamined Patent Application Publication No. 2012-229650

[PTL 5] Japanese Unexamined Patent Application Publication No. 2013-144940

SUMMARY OF INVENTION

Technical Problem

As described above, in the scroll compressors in which the discharge cavity is provided inside the housing, the detailed configurations of the housings or detailed fixing structures of the fixed scrolls are slightly different from each other. However, the scroll compressors have common configurations such as the housing being configured of two components such as the front housing and the rear housing, the scroll compression mechanism including the pair of a fixed scroll and orbiting scroll being incorporated into the housing, and the discharge cavity being formed between the end plate back face of the fixed scroll and the rear housing. In addition, in the scroll compressors, the above-described four components are bolt-fastened on two cross-sections (fixed scroll and rear housing, and front housing and rear housing, and front housing and fixed scroll, and fixed scroll and rear housing) or one cross-section (simultaneous fastening of three components such as fixed scroll, rear housing, and front housing).

In this way, in the scroll compressor of the related art, at least four components such as the front housing, the rear housing, the orbiting scroll, and the fixed scroll are indispensible, and thus, the four components are bolt-fastened on two cross-sections or one cross-section. Accordingly, the number of components increases and the structure is complicated. Therefore, a decrease in size or weight, a reduction in assembly man-hours, a reduction in cost or the like of the scroll compressor has approximately reached a limit.

The present invention is made in consideration of the above-described circumstance, and an object thereof is to provide a scroll compressor in which simplification of structure, a decrease in size and weight, a reduction in assembly man-hours, a reduction in cost, or the like is improved by configuring the housing and the scroll compression mechanism having four indispensible components using three components.

Solution to Problem

In order to achieve the above-described object, a scroll compressor of the present invention adopts the following means.

That is, according to a first aspect of the present invention, there is provided a scroll compressor including: a housing; and a scroll compression mechanism which is accommodated and installed inside the housing, in which an discharge cavity for discharging a high-pressure gas compressed by the scroll compression mechanism is formed inside the housing, the housing is configured of a front housing and a rear housing which closes a rear-end opening of the front housing, a fixed scroll configuring the scroll compression mechanism is integrally molded on the rear housing via a rib part, and an discharge cavity to which an discharge port for discharging the high-pressure gas opens is provided around the rib part, and an discharge valve for opening and closing the discharge port is installed inside the discharge cavity.

According to the first aspect, the fixed scroll configuring the scroll compression mechanism is integrally molded on the rear housing configuring the housing via the rib part, the discharge cavity to which an discharge port for discharging the high-pressure gas compressed by the scroll compression mechanism opens is provided around the rib part, and the discharge valve for opening and closing the discharge port is installed inside the discharge cavity. In general, in a case of the scroll compressor in which the discharge cavity is provided inside the housing, at least four components such as the front housing and the rear housing configuring the housing and the orbiting scroll and the fixed scroll configuring the scroll compression mechanism are indispensible, and it is necessary to bolt-fasten the four components on two cross-sections (fixed scroll and rear housing, and front housing and rear housing) or one cross-section (simultaneous fastening of three components such as fixed scroll, rear housing, and front housing). However, the above-described configuration is adopted, and thus, it is possible to fasten or connect three components such as the orbiting scroll, the front housing, and the rear housing+the fixed scroll on one cross-section (front housing and rear housing). Accordingly, since fastening bolts are not required, the number of fastening bolts decreases, the number of components of the housing and the scroll compression mechanism decreases (four components are reduced to three components), or the like, simplification of structure can be achieved, and it is possible to achieve a decrease in size or weight and a reduction in assembly man-hours of the scroll compressor, and a reduction in cost or the like can be achieved.

In addition, in the scroll compressor according to the second aspect of the present invention, in the above-described scroll compressor, the discharge cavity is separated from an intake cavity side by a first seal member which is interposed between an end-plate outer periphery of the fixed scroll and an inner periphery of the front housing, and the discharge cavity is separated from the atmosphere side by a second seal member which is interposed between the rear housing and the rear-end opening of the front housing, or a welding structure which is interposed therebetween.

According to the second aspect, the discharge cavity formed around the rib part is separated from the intake cavity side by the first seal member which is interposed between the end-plate outer periphery of the fixed scroll and the inner periphery of the front housing. In addition, the discharge cavity is separated from the atmosphere side by a second seal member which is interposed between the rear housing and the rear-end opening of the front housing, or a welding structure which is interposed therebetween. Accordingly, the discharge cavity, which is partition sealed with respect to the intake cavity and the atmosphere side, can be formed inside the housing by the first seal member and the second seal member, or the welding structure. Accordingly, it is possible to easily form the discharge cavity for decreasing discharge pulsation or the like in the housing without increasing the number of seal members or the like.

Moreover, in the scroll compressor according to a third aspect of the present invention, in the above-described scroll compressor, the first seal member is an O ring which is disposed on an outer periphery of an end plate of the fixed scroll, and the second seal member is an O ring or a gasket which is disposed on a fitting-portion outer periphery of the rear housing or the end surface of the rear housing.

According to the third aspect, the first seal member is an O ring which is disposed on the outer periphery of the end plate of the fixed scroll, and the second seal member is an O ring or a gasket which is disposed on the fitting-portion outer periphery of the rear housing or the end surface of the rear housing. Accordingly, by disposing the existing O rings or gasket on two seal portions, it is possible to form the discharge cavity, which is partition sealed with respect to the intake cavity and the atmosphere side, inside the housing. Therefore, it is possible to easily form an discharge cavity having a hermetically sealed structure inside the housing.

In addition, in the scroll compressor according to a fourth aspect of the present invention, in any one of the above-described scroll compressors, the rib part includes a main rib part which extends in radial directions of the rear housing and the fixed scroll, and a plurality of sub-rib parts which extend from the main rib part in a direction orthogonal to a longitudinal direction of the main rib part.

According to the fourth aspect, the rib part includes the main rib part which extends in radial directions of the rear housing and the fixed scroll, and the plurality of sub-rib parts which extend from the main rib part in a direction orthogonal to a longitudinal direction of the main rib part. Accordingly, the rear housing and the fixed scroll are integrated with each other via the main rib part and the sub-rib parts extending in predetermined directions, and thus, it is possible to easily perform integral molding by die-casting molding or the like. Accordingly, the number of components of the housing and the scroll compression mechanism is easily reduced from four to three, and thus, it is possible to achieve simplification of a structure, a decrease in size or weight, a reduction in assembly man-hours, a reduction in cost, or the like. In addition, according to the above-described disposition and configuration of the rib part, pressure-deformation of the fixed scroll end plate is decreased, and it is possible to improve compression performance.

In addition, in the scroll compressor according to a fifth aspect of the present invention, in any one of the above-described scroll compressors, the discharge port extends in an axial direction from the end plate side of the fixed scroll toward the rib part side, is bored in a radial direction therefrom, and opens to the inside of the discharge cavity on the side surface of the rib part.

According to the fifth aspect, the discharge port extends in the axial direction from the end plate of the fixed scroll toward the rib part side, is bored in the radial direction therefrom, and opens to the inside of the discharge cavity on the side surface of the rib part. Accordingly, the rear housing and the fixed scroll are integrally molded to each other via the rib part, and even when the discharge cavity is formed around the rib part, the discharge port provided on the end plate of the fixed scroll can extend so as to open to the inside of the discharge cavity via the rib part. Therefore, it is possible to easily form the discharge port or the discharge cavity without being influenced by integration between the rear housing and the fixed scroll.

Moreover, in the scroll compressor according to a sixth aspect of the present invention, in the above-described scroll compressor, the discharge valve, which is configured such that a reed valve is screw-fixed to the side surface of the rib part via a valve retainer, is provided so as to be openable and closable on the discharge port.

According to the sixth aspect, the discharge valve, which is configured such that the reed valve is screw-fixed to the side surface of the rib part via the valve retainer, is provided so as to be openable and closable on the discharge port. Accordingly, a reed-valve type discharge valve having high reliability can be installed on the discharge port by screw-fixing the valve retainer to the rib part in the side surface direction. Therefore, as the discharge valve, a reed-valve type discharge valve which has a simple configuration and high reliability and is widely used in the related art can be adopted.

In addition, in the scroll compressor according to a seventh aspect of the present invention, in any one of the above-described scroll compressors, the rib part is formed so as to avoid the discharge port which opens to an end plate center portion of the fixed scroll, and the discharge valve is installed on the discharge port via a valve retainer which is screwed to an end plate end surface of the fixed scroll in the axial direction.

According to the seventh aspect, the rib part is formed so as to avoid the discharge port which opens to the end plate center portion of the fixed scroll, and the discharge valve is installed on the discharge port via the valve retainer which is screwed to an end plate end surface of the fixed scroll in the axial direction. Accordingly, the rib part which integrally molds the rear housing and the fixed scroll is provided so as to avoid the discharge port which opens to the end plate center portion of the fixed scroll, and thus, it is possible to install the discharge valve on the end plate of the fixed scroll without changing an optimized discharge port or the configuration of the discharge valve which opens and closes the discharge port. Accordingly, it is possible to minimize pressure loss or the like in the discharge port or the discharge valve, and it is possible to maintain high performance.

In addition, in the scroll compressor according to an eighth aspect of the present invention, in the scroll compressor, a locking screw of the discharge valve is provided at a position corresponding to an installation hole of a high-pressure relief valve for protecting an discharge pressure or a TD thermostat for an discharge temperature which is installed on the end surface of the rear housing so as to communicate with the inside of the discharge cavity, and is able to be fastened in the axial direction.

According to the eighth aspect, the locking screw of the discharge valve is provided at a position corresponding to the installation hole of the high-pressure relief valve for protecting an discharge pressure or the TD thermostat for an discharge temperature which is installed on the end surface of the rear housing so as to communicate with the inside of the discharge cavity, and is able to be fastened in the axial direction. Accordingly, even when the rear housing and the fixed scroll are integrated with each other, the locking screw which fixes the discharge valve to the end plate of the fixed scroll is fastened-fixed to the end plate in the axial direction using the existing installation hole of the high-pressure relief valve or the TD thermostat which is provided on the end surface of the rear housing, and thus, it is possible to easily fix the discharge valve. Therefore, it is possible to easily perform the installation of the discharge valve using the existing hole and without providing a new hole or the like.

Advantageous Effects of Invention

According to the present invention, it is possible to fasten or connect three components such as the orbiting scroll, the front housing, and the rear housing+the fixed scroll of the scroll compressor having the discharge cavity inside the housing on one cross-section (front housing and rear housing). Accordingly, since fastening bolts are not required, the number of fastening bolts decreases, the number of components of the housing and the scroll compression mechanism decreases (four components are reduced to three components), or the like, simplification of structure is achieved, and it is possible to achieve a decrease in size or weight and a reduction in assembly man-hours of the scroll compressor, and a reduction in cost or the like can be achieved.

DESCRIPTION OF EMBODIMENTS

Hereinafter, embodiments according to the present invention will be described with reference to the drawings.

First Embodiment

Hereinafter, a first embodiment of the present invention will be described with reference to FIGS. 1A to 4B.

Figure 1B:
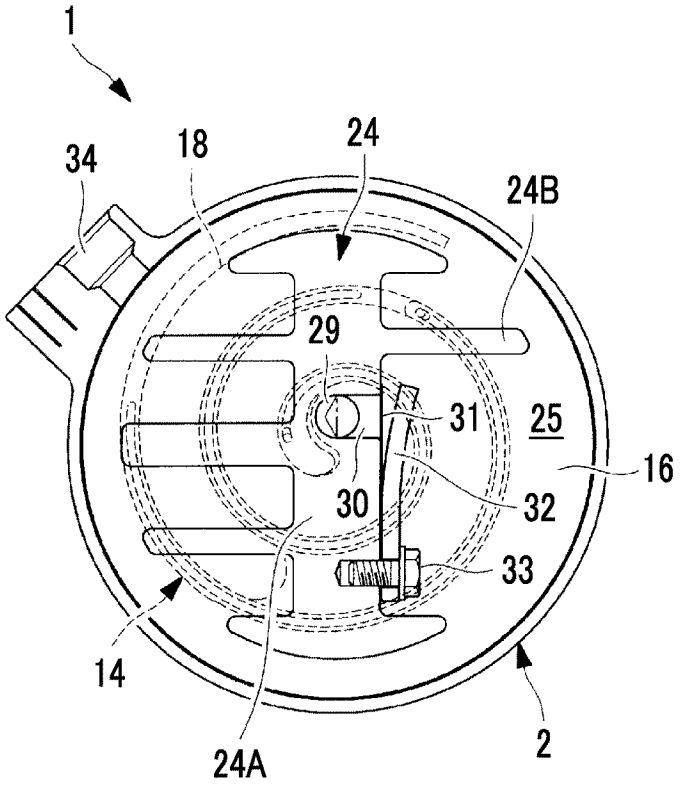
FIG. 1B is an orthogonal sectional view at a position of a rib part of the scroll compressor.
Figure 1A:
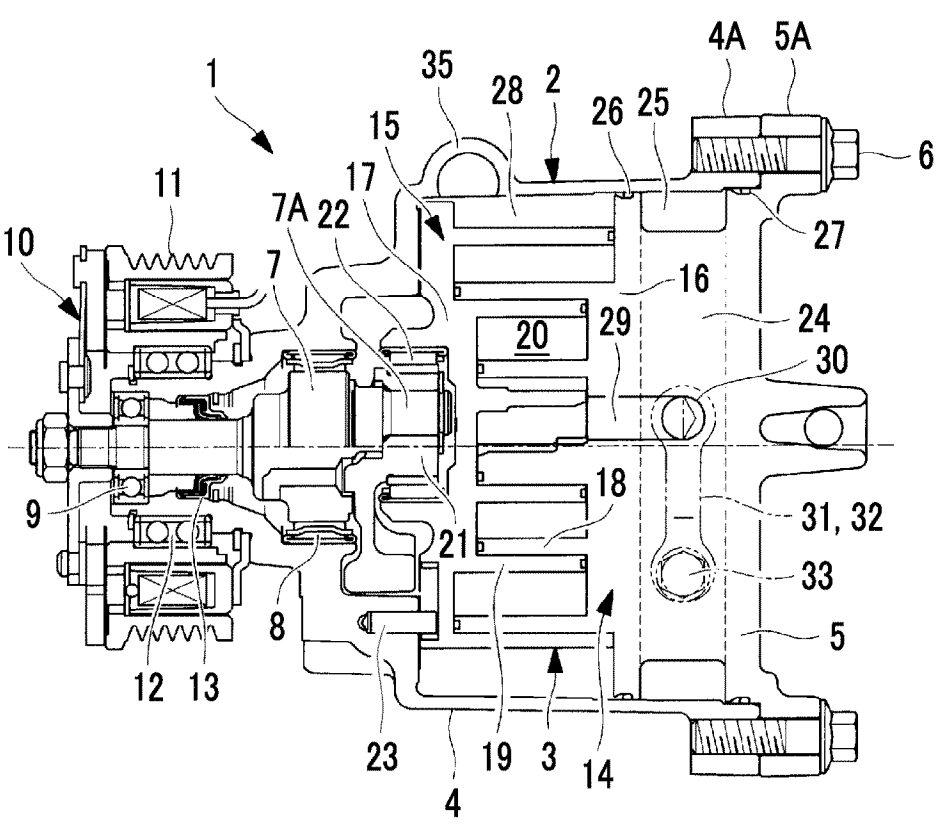
FIG. 1A is a longitudinal sectional view of a scroll compressor according to a first embodiment of the present invention.

FIG. 1A is a longitudinal sectional view of a scroll compressor according to the first embodiment of the present invention, and FIG. 1B is an orthogonal sectional view at a position of a rib part of the scroll compressor.

A scroll compressor 1 includes a housing 2 which configures the outline of the compressor, and a scroll compression mechanism 3 which is incorporated into the housing.

The housing 2 includes a tubular front housing 4 which has an opened rear end side, and a rear housing 5 which has an outer peripheral portion fitted to the rear-end opening of the front housing 4 and is integrally fastened-fixed to the front housing 4 via a plurality of bolts 6. The front housing 4 and the rear housing 5 are manufactured by aluminum die casting, and flanged portions 4A and 5A for fastening and fixing the front housing 4 and the rear housing 5 via the bolts 6 are provided on the outer peripheries at four to eight locations with equal gaps.

In the front end side of the front housing 4, the diameter of the front housing 4 decreases in stages, and the tip portion of the front housing 4 opens such that one end portion of a drive shaft (crank shaft) 7 protrudes. The drive shaft 7 is rotatably supported inside the front end side of the front housing 4 via a pair of main bearing 8 and a sub bearing 9, and a pulley 11 is provided on the end of the drive shaft 7, which protrudes from the front end opening of the front housing 4 toward the outside, via an electromagnetic clutch 10. The pulley 11 is rotatably supported on the front end outer periphery of the front housing 4 via a bearing 12.

Driving power from an external drive source such as an engine is input to the pulley 11 via a belt, and the scroll compressor 1 is driven by intermitting the driving power using the electromagnetic clutch 10. In addition, as well-known, the front end opening of the front housing 4 is hermetically sealed via a lip seal, a mechanical seal 13, or the like through which the drive shaft 7 passes, and thus, the inside of the housing 2 is shield from the outside air.

The scroll compression mechanism 3 which is accommodated and installed inside the housing 2 includes a pair of a fixed scroll 14 and orbiting scroll 15. In the fixed scroll 14 and the orbiting scroll 15, scroll laps 18 and 19 are erected on one surface of disk-shaped end plates 16 and 17, the scroll laps 18 and 19 engage with each other so as to be deviated by 180° phases, and a pair of compression chambers 20 is formed. Each compression chamber 20 is moved from the outer peripheral position thereof to the center position by revolution-turning driving of the orbiting scroll 15 while the volume of the compression chamber 20 decreases, and thus, refrigerant gas is compressed. This scroll compression mechanism 3 is well known.

A crank pin 7A provided on the inner end side of the drive shaft 7 is connected to a boss portion provided on the back face side of the end plate 17 via a drive bush 21 and a turning bearing 22, and thus, the orbiting scroll 15 is revolution-turning driven. In addition, during the revolution-turning driving, rotation of the orbiting scroll 15 is prevented by a rotation prevention mechanism 23. In addition, a thrust force acting on the orbiting scroll 15 is supported by a thrust bearing surface of the front housing 4 with which the back face of the end plate 17 is in contact.

Meanwhile, the fixed scroll 14 is integrally molded with the rear housing 5 via a rib part 24. That is, a portion between the back face of the disk-shaped end plate 16 of the fixed scroll 14 and the inner surface of the rear housing 5 is configured so as to be joined to each other by the rib part 24, and this configuration is integrally molded by die-casting molding or the like. As shown in FIGS. 1A and 1B, the rib part 24 is a skeleton-shaped rib which includes a main rib part 24A which radially extends through the centers of the end plate 16 and the rear housing 5 and a plurality of sub-rib parts 24B which extend in an orthogonal direction from the main rib part 24A, and the rib part 24 can be integrally molded by extracting molds in the extension directions of the sub-rib parts 24B.

An discharge cavity 25 having a constant internal volume is formed around the rib part 24, and in order to secure strength with respect to pressure-deformation of the end plate 16 on the fixed scroll 14 side, the rib part 24 has the above-described skeleton shape. In addition, in a state where seal members 26 and 27 such as O rings are disposed on groove portions of the end plate 16 of the fixed scroll 14 and the outer peripheral portion of the rear housing 5 which are integrated with each other via the rib part 24, the end plate 16 and the outer peripheral portion are inserted into the front housing 4 and are fastened to the front housing 4 by a plurality of bolts 6. Accordingly, an discharge cavity 25 having a hermetically sealed structure is formed inside the housing 2, and the hermetically sealed structure is partition sealed with respect to an intake cavity 28 via the seal member (first seal member) 26 and is partition sealed with respect to the atmosphere side via the seal member (second seal member) 27.

In addition, an discharge port 29 is axially provided in the vicinity of the center of the end plate 16 of the fixed scroll 14, and a high-pressure gas compressed in the compression chamber 20 is expelled to the discharge cavity 25 through the discharge port 29. After the discharge port 29 extends to the rib part 24 side, a port extension portion 30 is bored in the radial direction from the end of the discharge port 29, and thus, the discharge port 29 opens to the inside of the discharge cavity 25 on the side surface of the main rib part 24A. A reed-valve type discharge valve 31 is fixed to the opening via a valve retainer 32 and a locking screw 33 so as to open and close the discharge port 29.

In addition, fitting portions 34 and 35 for connecting a refrigerant discharge pipe and a refrigerant intake pipe are provided on the rear end portion and the front end portion of the front housing 4 so as to communicate with the discharge cavity 25 and the intake cavity 28.

According to the present embodiment having the above-described configuration, the following effects are obtained.

In the scroll compressor 1, if the electromagnetic clutch 10 is turned on, driving power from an external drive source such as an engine is transmitted to the drive shaft (crank shaft) 7 via the pulley 11 and the electromagnetic clutch 10, and the drive shaft 7 is rotationally driven. Accordingly, the orbiting scroll 15 is revolution-turning driven, a low-pressure refrigerant gas suctioned into the intake cavity 28 via the fitting portion 35 is taken into the compression chamber 20 so as to be sequentially compressed.

The refrigerant gas, which has been compressed so as to reach a predetermined high pressure in the compression chamber 20, passes through the discharge port 29 and the extension portion 30 thereof, pushes the discharge valve 31 so as to open the discharge valve 31, and is expelled into the discharge cavity 25. After discharge pulsation or the like of the high-pressure refrigerant gas expelled into the discharge cavity 25 decreases inside the discharge cavity 25, the high-pressure refrigerant gas is circulated through a refrigeration cycle by the refrigerant discharge pipe via the fitting portion 35. The compression effects of the refrigerant gas are not different from those of the refrigerant gas in the known scroll compressor.

As described above, in the case where the scroll compressor 1 which includes the discharge cavity 25 inside the housing 2 is configured, in general, at least four components such as the front housing 4 and the rear housing 5 configuring the housing 2, and the fixed scroll 14 and the orbiting scroll 15 configuring the scroll compression mechanism 3 are necessary. In the related art, the four components are fastened to each other by bolts on two cross-sections (fixed scroll 14 and rear housing 5, and front housing 4 and rear housing 5) or one cross-section (simultaneous fastening of three components such as fixed scroll 14, the rear housing 5, and front housing 4), and the discharge cavity 25 is formed between the end plate back face of the fixed scroll 14 and the rear housing 5.

However, in the present embodiment, the fixed scroll 14 configuring the scroll compression mechanism 3 is integrally molded with the front housing 4 and the rear housing 5 configuring the housing 2 via the rib part 24, and the discharge port 29 for discharging a high-pressure gas compressed by the scroll compression mechanism 3, and the discharge cavity 25 to which the extension portion 30 opens are formed around the rib part 24. In addition, the discharge valve 31 for opening and closing the discharge port 29 and the extension portion 30 is installed in the discharge cavity 25.

Accordingly, unlike the above-described four component-structure of the related art, three components such as the orbiting scroll 15, the front housing 4, and the rear housing 5+the fixed scroll 14 can be fastened or connected to each other on one cross-section (front housing 4 and rear housing 5). Accordingly, since fastening bolts are not required, the number of the fastening bolts decreases, the number of components of the housing 2 and the scroll compression mechanism 3 decreases (four components are reduced to three components), or the like, simplification of structure can be achieved, and it is possible to achieve a decrease in size or weight and a reduction in assembly man-hours of the scroll compressor 1, and a reduction in cost or the like can be achieved.

In addition, in the present embodiment, the discharge cavity 25 formed around the rib part 24 is separated from the intake cavity 28 side by the first seal member 26 which is interposed between the outer periphery of the end plate 16 of the fixed scroll 14 and the inner periphery of the front housing 4, and the discharge cavity 25 is separated from the atmosphere side by the second seal member 27 which is interposed between the outer periphery of the rear housing 27 and the inner periphery of the front housing. Accordingly, the discharge cavity 25, which is partition sealed with respect to the intake cavity 28 and the atmosphere, can be formed inside the housing 2 by the first seal member 26 and the second seal member 27. Therefore, it is possible to easily form the discharge cavity 25 for decreasing discharge pulsation or the like in the housing 2 without increasing the number of seal members or the like.

In addition, the first seal member 26 and the second seal member 27 respectively are O rings which are disposed on the outer periphery of the end plate 16 of the fixed scroll 14 and the fitting-portion outer periphery of the rear housing 5. Accordingly, by disposing the existing O rings on two seal portions, it is possible to form the discharge cavity 25, which is partition sealed with respect to the intake cavity 28 and the atmosphere, inside the housing 2. Therefore, it is possible to easily form an discharge cavity 25 having a hermetically sealed structure inside the housing 2.

Moreover, in the present embodiment, the rib part 24 includes the main rib part 24A which extends in radial directions of the housing 2 and the fixed scroll 14, and the plurality of sub-rib parts 24B which extend in the orthogonal direction from the main rib part 24A. Accordingly, the rear housing 5 and the fixed scroll 14 are integrated with each other via the main rib part 24A and the sub-rib parts 24B extending predetermined directions, and thus, it is possible to easily perform integral molding between the rear housing 5 and the fixed scroll 14 by die-casting molding or the like. Therefore, the number of components of the housing 2 and the scroll compression mechanism 3 is easily reduced from four to three, and thus, it is possible to achieve simplification of a structure, a decrease in size or weight, a reduction in assembly man-hours, a reduction in cost, or the like. In addition, according to the above-described disposition and configuration of the rib part 24, pressure-deformation of the fixed scroll end plate 16 is decreased, and it is possible to improve compression performance.

Moreover, the discharge port 29 extends in the axial direction from the end plate 16 of the fixed scroll 14 toward the rib part 24 side, the extension portion 30 is bored in the radial direction, and the discharge port 29 opens to the inside of the discharge cavity 25 on the side surface of the rib part 24. Accordingly, even when the rear housing 5 and the fixed scroll 14 are integrally molded to each other via the rib part 24, and even when the discharge cavity 25 is formed around the rib part 24, the discharge port 29 provided on the end plate 16 of the fixed scroll 14 can extend so as to open to the inside of the discharge cavity 25 via the rib part 24. Therefore, it is possible to easily form the discharge port 29 or the discharge cavity 25 without being influenced by integration between the rear housing 5 and the fixed scroll 14.

Moreover, in the present embodiment, the discharge valve 31, which is configured such that the reed valve is screw-fixed to the side surface of the rib part 24 by the locking screw 33 via the valve retainer 32, is provided so as to be openable and closable on the discharge port 29. Accordingly, a reed-valve type discharge valve 31 having high reliability can be installed on the discharge port 29 by screw-fixing the valve retainer 32 to the rib part 24 in the side surface direction using the locking screw 33. Therefore, as the discharge valve 31, a reed-valve type discharge valve 31 which has a simple configuration and high reliability and is widely used in the related art can be adopted.

Moreover, in the present embodiment, the partition seal of the discharge cavity 25 with respect to the atmosphere side is realized by the second seal member (0 ring) 27 which is disposed on the fitting-portion outer periphery of the rear housing 5. However, the following modification examples 1 to 3 shown in FIGS. 2A to 4B may be adopted.

Modification Example 1

Figure 2B:
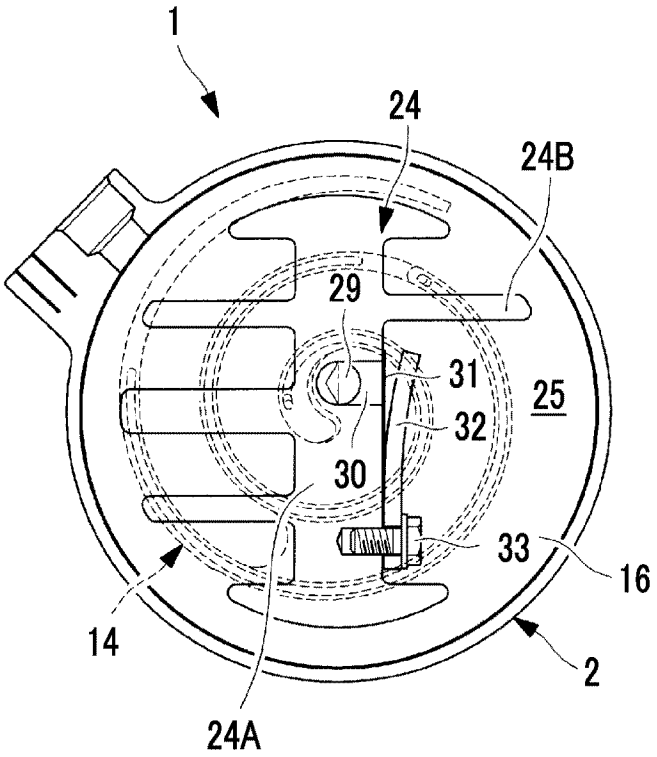
FIG. 2B is an orthogonal sectional view at a position of a rib part of the scroll compressor.
Figure 2A:
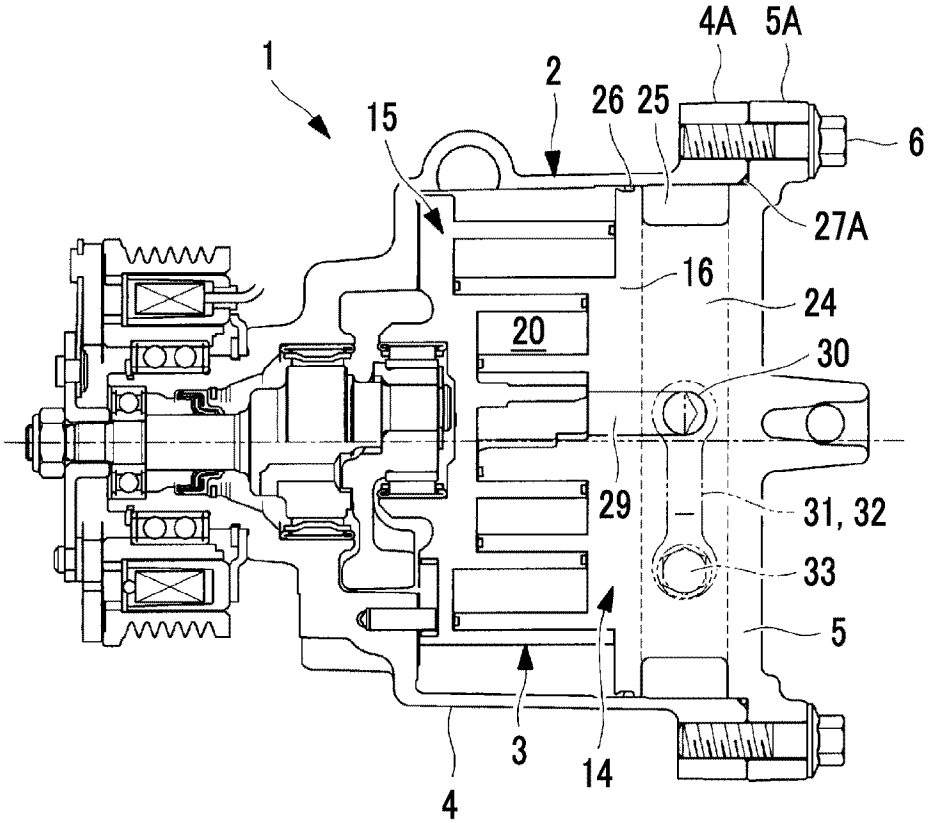
FIG. 2A is a longitudinal sectional view of Modification Example 1 of the scroll compressor shown in FIGS. 1A and 1B.

As shown in FIGS. 2A and 2B, in Modification Example 1, a second seal member 27A is an O ring, and the O ring 27A is disposed on a triangular corner portion which is formed between the rear-end opening of the front housing 4 and the rear housing 5 fitted to the rear-end opening.

According to this configuration, the fitting portion length of the rear housing 5 with respect to the rear-end opening of the front housing 4 can be shortened, the length of the housing 2 in the axial direction is shortened by the length of the fitting portion, and thus, it is possible to decrease the size of the scroll compressor 1.

Modification Example 2

Figure 3B:
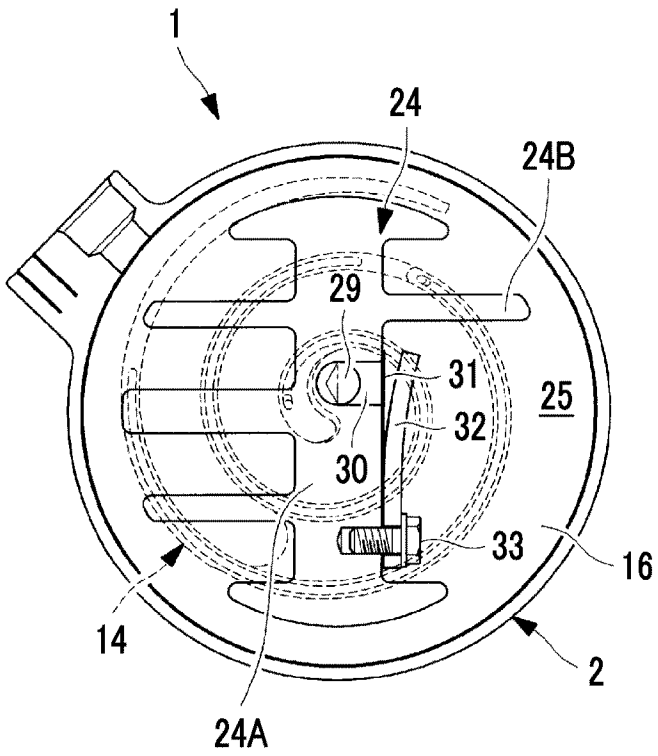
FIG. 3B is an orthogonal sectional view at a position of a rib part of the scroll compressor.
Figure 3A:
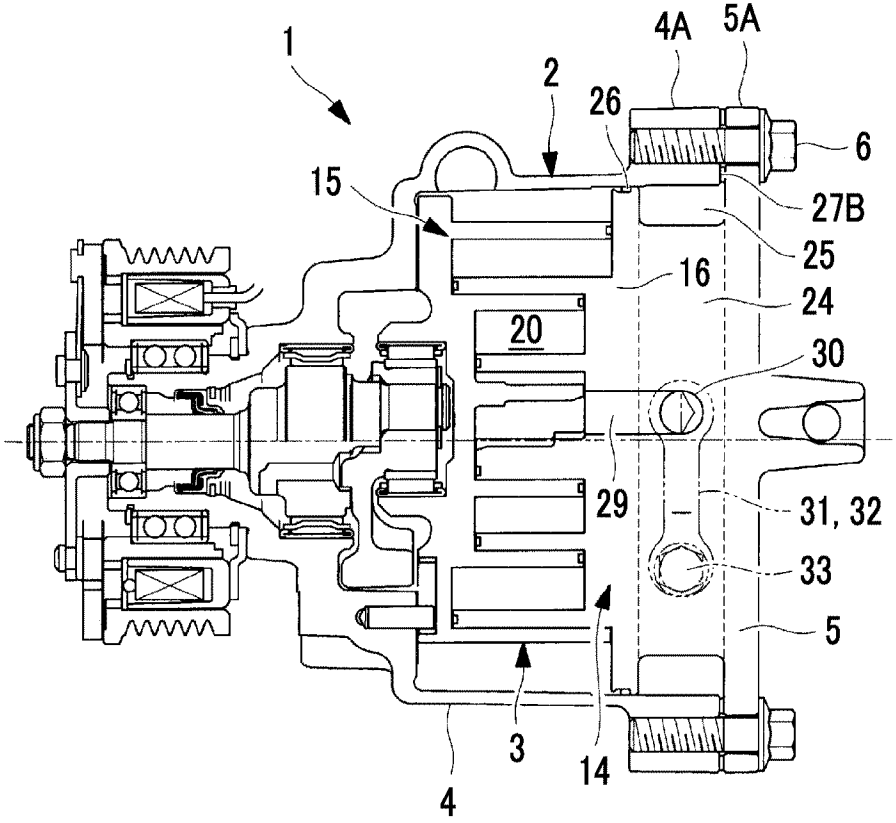
FIG. 3A is a longitudinal sectional view of Modification Example 2 of the scroll compressor shown in FIGS. 1A and 1B.

As shown in FIGS. 3A and 3B, in Modification Example 2, a second seal member 27B is a gasket, the gasket 27B is interposed between the rear end surface of the front housing 4 and the end surface of the rear housing 5, and is fastened-fixed by a bolt 6 so as to be sealed.

According to this configuration, since the fitting portion of the rear housing 5 with respect to the rear-end opening of the front housing 4 is not required, the length of the housing 2 in the axial direction is shortened by the length of the fitting portion, and it is possible to decrease the size of the scroll compressor 1.

Modification Example 3

Figure 4B:
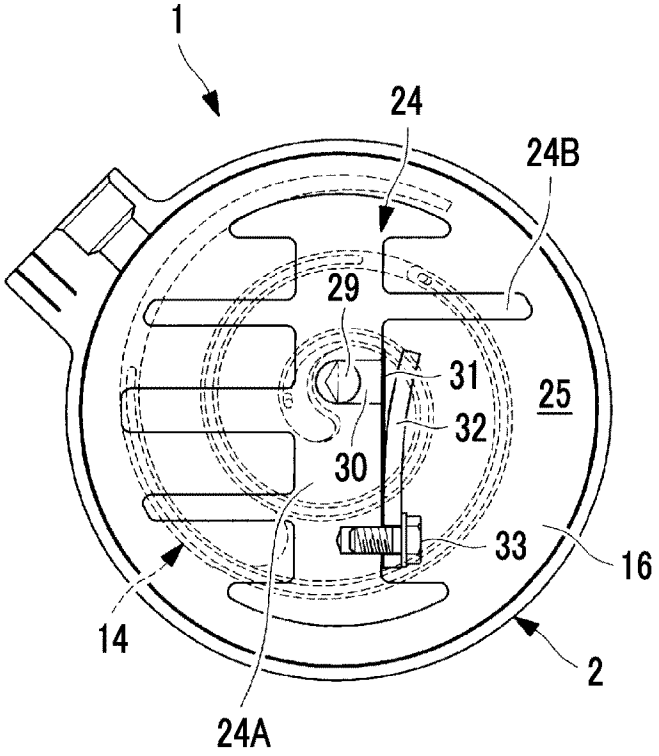
FIG. 4B is an orthogonal sectional view at a position of a rib part of the scroll compressor.
Figure 4A:
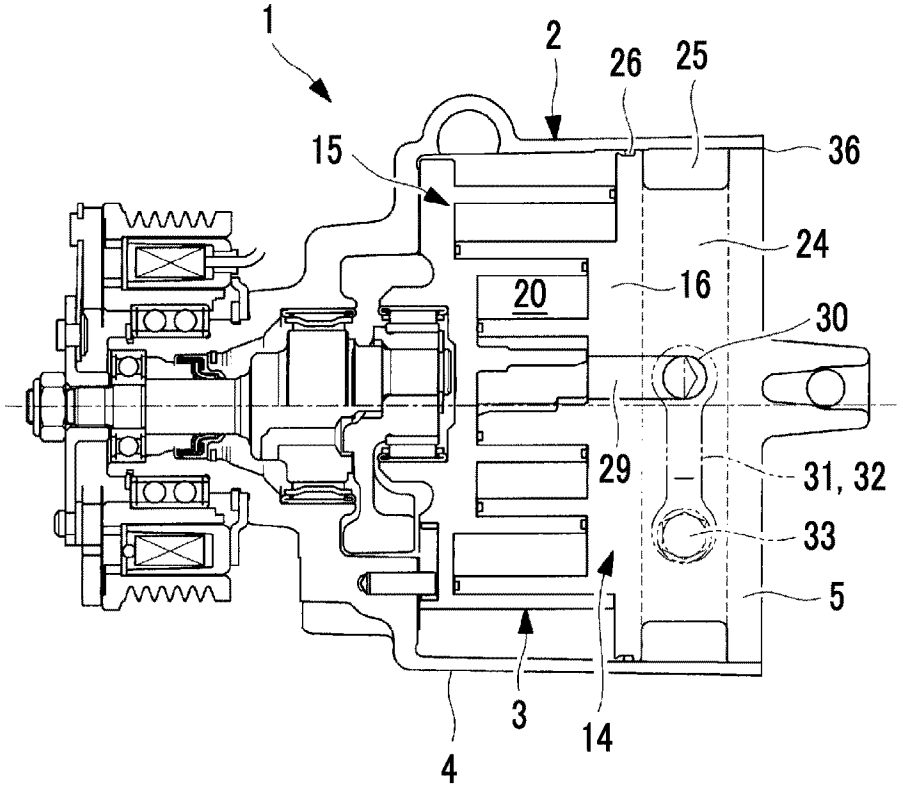
FIG. 4A is a longitudinal sectional view of Modification Example 3 of the scroll compressor shown in FIGS. 1A and 1B.
Figure 5B:
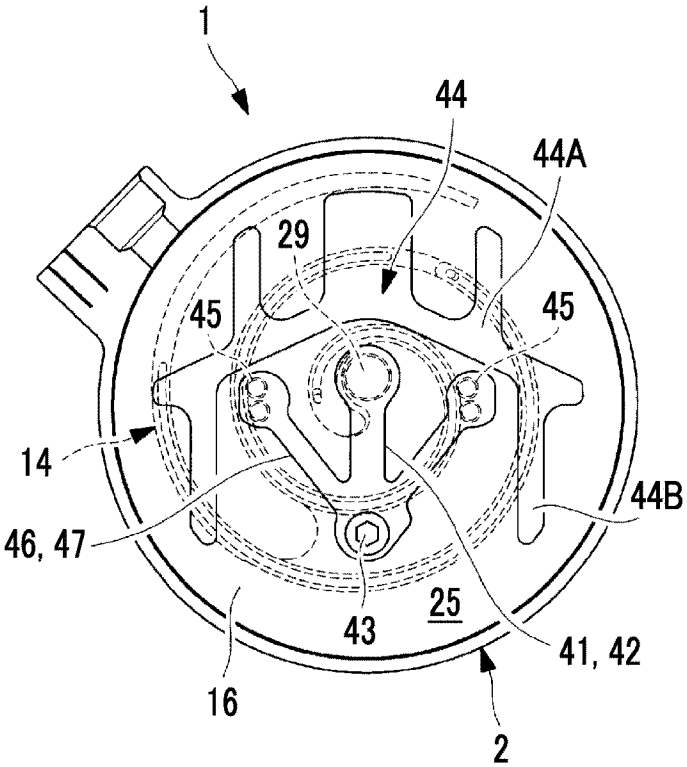
FIG. 5B is an orthogonal sectional view at a position of a rib part of the scroll compressor.
Figure 5A:
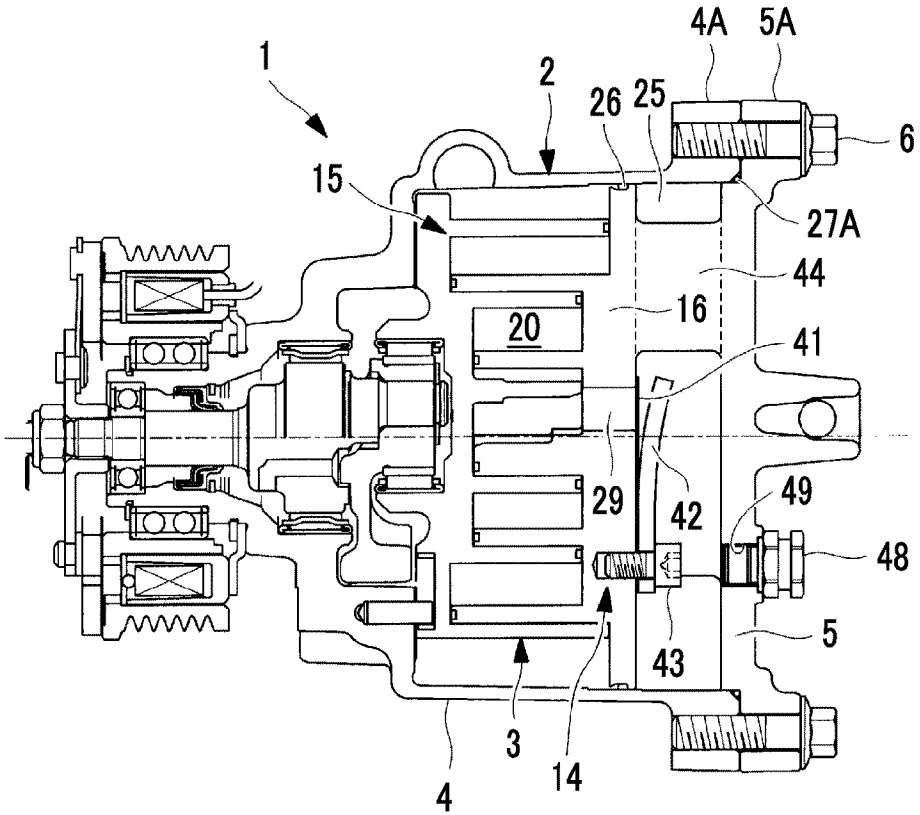
FIG. 5A is a longitudinal sectional view of a scroll compressor according to a second embodiment of the present invention.

As shown in FIGS. 4A and 4B, in Modification Example 3, instead of the second seal member, the partition seal of the discharge cavity 25 with respect to the atmosphere side adopts the entire peripheral welding structure (brazing structure) 36.

In this way, the welding structure (brazing structure) 36 may be adopted instead of the second seal member, and in this case, the flanged portions 4A and 5A on the front housing 4 and the rear housing 5 may be omitted, and the bolt 6 may be omitted. Accordingly, it is possible to further decrease the size of the scroll compressor 1, and it is possible to achieve simplification of a structure.

Second Embodiment

Next, a second embodiment of the present invention will be described with reference to FIGS. 5A and 5B and FIGS. 6A and 6B.

Compared to the above-described first embodiment, in the present embodiment, the configuration of the rib part 44, the installation and configuration of an discharge valve 41, the configuration of a multi-port 45, or the like is different.

Other points are similar to those of the first embodiment, and descriptions thereof are omitted.

In the present embodiment, the rib part 44 for joining and integrally molding the rear housing 5 and the fixed scroll 14 is configured so as to avoid the discharge port 29 which is provided at the center portion of the end plate 16 of the fixed scroll 14.

That is, a main rib part 44A which extends in the radial directions of the rear housing 5 and the fixed scroll 14 is provided to be bent in a < shape (a V shape when the compressor is viewed in the axial direction) to avoid the discharge port 29 provided on the end plate center portion of the fixed scroll 14, and a plurality of sub-rib parts 44B extends in multiple lines to be parallel to each other in both side directions from the main rib part 44A. In addition, the discharge port 29 opening to the back face of the end plate 16 of the fixed scroll 14 directly opens to the inside of the discharge cavity 25, and the discharge port 29 can be opened and closed by the reed-valve type discharge valve 41 installed on the back face of the end plate 16 of the fixed scroll 14 via the valve retainer 42 and the locking screw 43.

Moreover, in the present embodiment, a pair of discharge holes (multi-port) 45 is provided at symmetrical positions on the end plate 16 of the fixed scroll 14. Accordingly, when an internal pressure exceeds a predetermined pressure in a step before the compression chamber 20 communicates with the discharge port 29, the discharge holes (multi-ports) 45 expel a high-pressure gas to the discharge cavity 25 so as to prevent excessive compression, and the multi-ports 45 can be opened and closed by a reed-valve type multi-port valve 46 which is integrated with the discharge valve 41. The multi-port valve 46 includes a valve retainer 47 which is integrated with the valve retainer 42 of the discharge valve 41.

In addition, in order to axially fasten the locking screw 43 which screws the discharge valve 41, the valve retainer 42, the multi-port valve 46, and the valve retainer 47 to the back face of the end plate 16 of the fixed scroll 14, the screw position is provided at the position corresponding to a high-pressure relief valve 48 for protecting an discharge pressure which is installed on the end surface of the rear housing 5, and thus, the locking screw 43 can be fastened using an installation hole 49 of the high-pressure relief valve 48. In addition, when an discharge pressure abnormally increases and exceeds a set pressure, from the perspective of security, the high-pressure relief valve 48 for protecting an discharge pressure is provided so as to expel the pressure to the atmosphere.

As described above, the configuration of the rib part 44 is changed so as to avoid the discharge port 29, the discharge port 29 opening to the end plate 16 of the fixed scroll 14 can directly open to the inside of the discharge cavity 25, and thus, the discharge port 29 can be opened and closed by the reed-valve type discharge valve 41 which is installed on the end plate 16 of the fixed scroll 14. Accordingly, the optimized discharge port 29 or discharge valve 41 can be installed on the end plate 16 of the fixed scroll 14 without specifically changing the structure of the discharge port 29 or discharge valve 41, pressure loss at the discharge port 29 or the discharge valve 41 is minimized, and high performance can be maintained.

Moreover, the locking screw 43 which installs the discharge valve 41 on the end plate 16 of the fixed scroll 14 is fastened in the axial direction using the existing installation hole 49 of the high-pressure relief valve 48 provided on the end surface of the rear housing 5, and thus, it is possible to easily fix and install the discharge valve 41. Accordingly, the discharge valve 41 can be installed by effectively using the existing hole, and thus, the installation can be easily performed without providing a new hole or the like. In addition, the sub-rib parts 44B may be disposed on the multi-ports 45 so as to easily adopt a multi-port type excessive compression prevention mechanism.

Modification Example

Figure 6B:
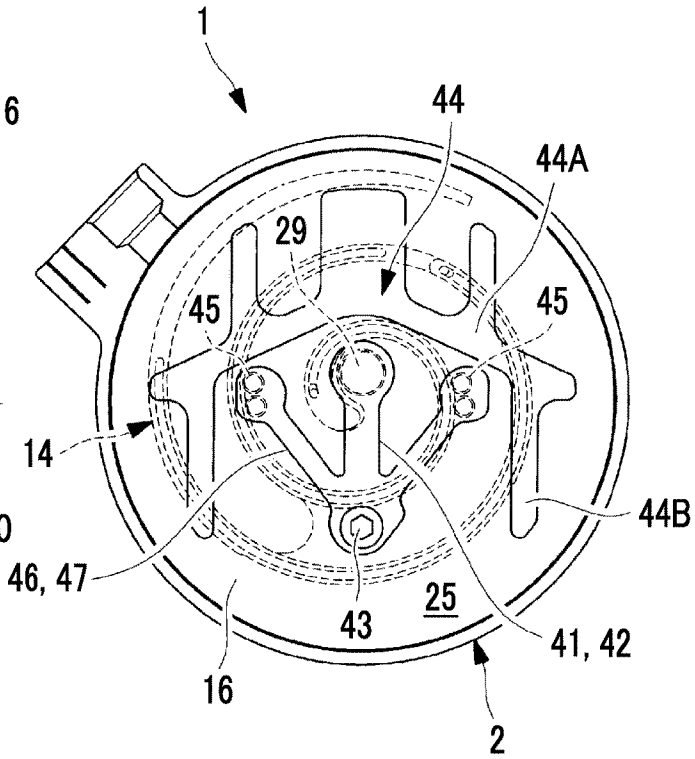
FIG. 6B is an orthogonal sectional view at a position of a rib part of the scroll compressor.
Figure 6A:
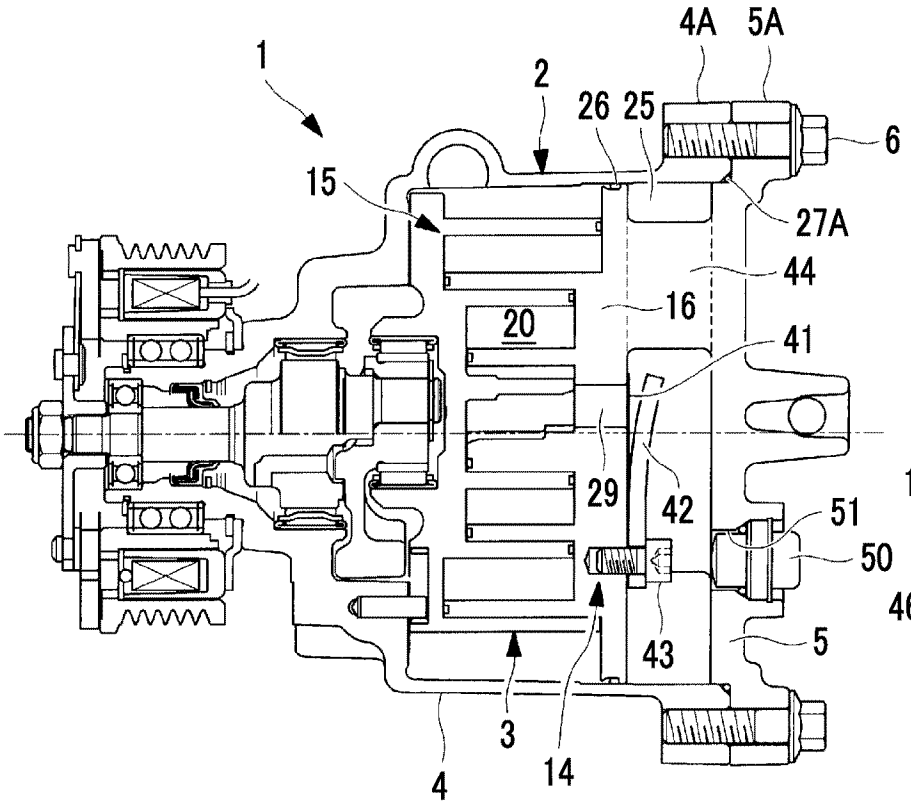
FIG. 6A is a longitudinal sectional view of Modification Example of the scroll compressor shown in FIGS. 5A and 5B.

In the above-described second embodiment, the installation hole 49 of the high-pressure relief valve 48 is used so as to fasten the locking screw 43 which installs the discharge valve 41. Meanwhile, as shown in FIGS. 6A and 6B, in addition to the high-pressure relief valve 48, a TD thermostat 50 for protecting an discharge temperature is installed on the end surface of the rear housing 5. Accordingly, the screw position of the locking screw 43 for installing the discharge valve 41 may be set to a position corresponding to an installation hole 51 of the TD thermostat 50, and thus, it is possible to obtain effects similar to those of the second embodiment. When an discharge temperature abnormally increases and exceeds a set pressure, from the perspective of security, the TD thermostat 50 for protecting an discharge temperature is provided to detect the discharge temperature, perform a control for decreasing the discharge temperature, or stop the compressor when abnormality occurs.

Moreover, the present invention is not limited to the inventions according to the above-described embodiments, and modifications may be appropriately applied to the present invention within a scope which does not depart from the gist. For example, in the above-described embodiments, the example is described in which the embodiments are applied to an open type scroll compressor 1 in which a drive source is not built. However, it is needless to say that the present invention may be similarly applied to a half-closed type or a close type scroll compressor in which a motor serving as a drive source is built.

Moreover, in the above-described embodiments, the scroll compression mechanism 3 is a so-called three-dimensional compression type scroll compression mechanism which uses the staged fixed scroll 14 and orbiting scroll 15. However, of course, a typical two-dimensional compression type scroll compression mechanism may be used. In addition, the discharge valves 31 and 41 need not necessarily be a reed-valve type discharge valve, and other discharge valves may be used for the discharge valves 31 and 41.

REFERENCE SIGNS LIST

1: scroll compressor
2: housing
3: scroll compression mechanism
4: front housing
5: rear housing
14: fixed scroll
15: orbiting scroll
16: end plate of fixed scroll
24, 44: rib part
24A, 44A: main rib part
24B, 44B: sub-rib part
25: discharge cavity
26: first seal member (O ring)
27, 27A: second seal member (O ring)
27B: second seal member (gasket)
28: intake cavity
29: discharge port
30: port extension portion

31, 41: discharge valve
32, 42: valve retainer
33, 43: locking screw
36: welding structure (brazing structure)
48: high-pressure relief valve
49, 51: installation hole
50: TD thermostat

The invention claimed is:

1. A scroll compressor comprising: a housing; and a scroll compression mechanism which is accommodated and installed inside the housing, wherein a discharge cavity for discharging a high-pressure gas compressed by the scroll compression mechanism is formed inside the housing, wherein the housing is configured of a front housing and a rear housing which closes a rear-end opening of the front housing, wherein a fixed scroll configuring the scroll compression mechanism is integrally molded on the rear housing via a rib part, and wherein the discharge cavity to which a discharge port for discharging the high-pressure gas opens is provided around the rib part, and a discharge valve for opening and closing the discharge port is provided inside the discharge cavity.

2. The scroll compressor according to claim 1, wherein the discharge cavity is separated from an intake cavity side by a first seal member which is interposed between an end-plate outer periphery of the fixed scroll and an inner periphery of the front housing, and the discharge cavity is separated from the atmosphere side by a second seal member which is interposed between the rear housing and the rear-end opening of the front housing, or a welding structure which is interposed therebetween.

3. The scroll compressor according to claim 2, wherein the first seal member is an O ring which is disposed on an outer periphery of an end plate of the fixed scroll, and the second seal member is an O ring or a gasket which is disposed on a fitting-portion outer periphery of the rear housing or the end surface of the rear housing.

4. The scroll compressor according to claim 1, wherein the rib part includes a main rib part which extends in radial directions of the rear housing and the fixed scroll, and a plurality of sub-rib parts which extend from the main rib part in a direction orthogonal to a longitudinal direction of the main rib part.

5. The scroll compressor according to claim 1, wherein the discharge port extends in an axial direction from an end plate side of the fixed scroll toward a rib part side, is bored in a radial direction therefrom, and opens to the inside of the discharge cavity on a side surface of the rib part.

6. The scroll compressor according to claim 5, wherein the discharge valve, which is configured such that a reed valve is screw-fixed to the side surface of the rib part via a valve retainer, is provided so as to be openable and closable on the discharge port.

7. The scroll compressor according to claim 1, wherein the rib part is formed so as to avoid the discharge port which opens to an end plate center portion of the fixed scroll, and the discharge valve is installed on the discharge port via a valve retainer which is screwed to an end plate end surface of the fixed scroll in the axial direction.

8. The scroll compressor according to claim 7, wherein a locking screw of the discharge valve is provided at a position corresponding to an installation hole of a high-pressure relief valve for protecting an discharge pressure or a TD thermostat for an discharge temperature which is installed on an end surface of the rear housing so as to communicate with the inside of the discharge cavity, and is fastened in the axial direction.

* * * * *